US009717359B2

(12) United States Patent
Bolles

(10) Patent No.: US 9,717,359 B2
(45) Date of Patent: Aug. 1, 2017

(54) THEFT-RESISTANT WALL MOUNT MAILBOX

(71) Applicant: David J. Bolles, Sammamish, WA (US)

(72) Inventor: David J. Bolles, Sammamish, WA (US)

( * ) Notice: Subject to any disclaimer, the term of this patent is extended or adjusted under 35 U.S.C. 154(b) by 42 days.

(21) Appl. No.: 14/693,823

(22) Filed: Apr. 22, 2015

(65) Prior Publication Data

US 2015/0297013 A1 Oct. 22, 2015

Related U.S. Application Data

(60) Provisional application No. 61/982,864, filed on Apr. 22, 2014.

(51) Int. Cl.
*A47G 29/124* (2006.01)
*A47G 29/22* (2006.01)

(52) U.S. Cl.
CPC ..... *A47G 29/124* (2013.01); *A47G 29/22* (2013.01)

(58) Field of Classification Search
CPC ..... A47G 29/124; A47G 29/16; A47G 29/20; A47G 29/22; A47G 29/1209; A47G 29/1216
USPC ..... 232/17, 45, 47, 51, 39
See application file for complete search history.

(56) References Cited

U.S. PATENT DOCUMENTS 386,757 A * 7/1888 Regester ..... A47G 29/16 232/51
3,880,344 A * 4/1975 Earle ..... A47G 29/124 232/17
5,137,212 A * 8/1992 Fiterman ..... B65F 1/10 109/46
5,207,377 A * 5/1993 Brecht ..... A47G 29/1209 232/17
6,719,195 B2 * 4/2004 Farentinos ..... A47G 29/22 232/45
6,976,620 B2 * 12/2005 Swider ..... A47G 29/1207 232/45
7,175,071 B1 * 2/2007 Slagle ..... A47G 29/16 220/833
7,320,427 B2 * 1/2008 Prestwich ..... A47G 29/22 232/45
7,441,696 B2 * 10/2008 Bolles ..... A47G 29/1209 232/45
7,686,207 B1 * 3/2010 Jeffs ..... A47G 29/124 232/45
7,946,472 B2 * 5/2011 Bolles ..... A47G 29/22 109/68
8,573,473 B1 * 11/2013 Farentinos ..... A47G 29/22 232/45
8,960,530 B2 * 2/2015 Silke ..... A47G 29/22 232/45

(Continued)

*Primary Examiner* — William Miller
(74) *Attorney, Agent, or Firm* — Patrick J. S. Inouye; Krista A. Wittman

(57) ABSTRACT

A theft-resistant wall mount mailbox is provided. A housing has a rectangular shape with a front side and a back side. A rotatable mail deposit is pivotably attached to the front side of the housing and includes a mail delivery door, an inner panel affixed on a proximate end at an angle to a bottom of the mail delivery door, and a safety arm affixed at a further angle to a distal end of the inner panel. A mail retrieval door is located below the rotatable mail deposit and pivotably attached to the front side of the housing.

16 Claims, 6 Drawing Sheets

(56) References Cited

U.S. PATENT DOCUMENTS

| | | | | |
|---|---|---|---|---|
| 9,004,346 | B2 * | 4/2015 | Farentinos | A47G 29/22<br>232/43.3 |
| 2016/0166100 | A1 * | 6/2016 | Billue | A47G 29/1216<br>232/29 |

* cited by examiner

THEFT-RESISTANT WALL MOUNT MAILBOX

CROSS-REFERENCE TO RELATED APPLICATION

This non-provisional patent application claims priority to U.S. provisional patent application, Ser. No. 61/982,864, filed Apr. 22, 2014, the disclosure of which is incorporated by reference.

FIELD

The invention relates in general to mailboxes and, specifically, to a theft-resistant mailbox for wall mount applications that accepts mail bundles and small parcels.

BACKGROUND

Identity theft is currently the fastest growing crime in the U.S. Thieves frequently steal mail as an easy and relatively low risk way of acquiring personal information that may be assembled into viable and marketable information for identity theft. Many consumers purchase locking mailboxes in an attempt to thwart mail theft. Locking wall mount mailboxes are a popular product because they allow for space efficient mounting on walls that would not accommodate more traditional curbside locking mailbox designs. However, including a locking mechanism on wall mount mailboxes provides only a partial solution. Many of these products are inferior and are easily violated. Most locking wall mount mailboxes feature an incoming mail slot of various sizes to allow for receipt of mail. Bins are not typically employed in shallower style wall mount locking mailboxes since the bottom member of the bin door impedes mail delivery when the door is closed. The traditionally employed slot doors suffer from a design flaw that allows thieves to simply insert their arm or a fishing tool through the incoming mail slot and retrieve the contents, thereby bypassing the locked door. Access to the interior of the mailbox is formed when the un-lockable incoming mail door is opened. Wall mount mailboxes with incoming mail slots small enough to prevent fishing cannot accept mail bundles or small parcels. Thus there exists a tradeoff between ease of use and mail security in locking wall mount mailboxes. Accordingly, there is a need for a locking wall mount mailbox that incorporates theft-resistant design to deter fishing when the incoming mail door is opened, but still allows for receipt of mail bundles and small parcels.

SUMMARY

A theft-resistant wall mount locking mailbox includes a housing that has top and bottom plates, a rear wall, and one or more doors, which are affixed to a front surface of the housing, which enclose a space in which mail is received and stored. The doors can include a lockable mail retrieval door and a non-lockable mail delivery door, which are each pivotably attached to the front of the housing. The non-lockable mail delivery door can include a mail receiver bin door configured to receive mail bundles and small parcels. Specifically, the mail delivery door includes a top member affixed at an angle to a bottom member. The top member includes a substantially flat surface that faces the front of the mailbox in a closed position and the bottom member includes an angled surface located inside the housing that extends toward the front surface on the inside of the mailbox in an open position. The bottom member of the mail delivery door includes a downward-angled security arm to prevent would-be thieves from reaching their hand into the mailbox without impeding delivery of the mail into the mailbox.

Together, the top and bottom members move to open and close the mail delivery door. When the mail delivery door is closed, the mail bundles and small parcels fall to the bottom of the mailbox, where they can be retrieved via the lockable mail retrieval door.

A further embodiment provides a theft-resistant wall mount mailbox. A housing has a rectangular shape with a front side and a back side. A rotatable mail deposit is pivotably attached to the front side of the housing and includes a mail delivery door, an inner panel affixed on a proximate end at an angle to a bottom of the mail delivery door, and a safety arm affixed at a further angle to a distal end of the inner panel. A mail retrieval door is located below the rotatable mail deposit and pivotably attached to the front side of the housing.

Still other embodiments of the invention will become readily apparent to those skilled in the art from the following detailed description, wherein are described embodiments of the invention by way of illustrating the best mode contemplated for carrying out the invention. As will be realized, the invention is capable of other and different embodiments and its several details are capable of modifications in various obvious respects, all without departing from the spirit and the scope of the invention. Accordingly, the drawings and detailed description are to be regarded as illustrative in nature and not as restrictive.

DETAILED DESCRIPTION

Figure 1:
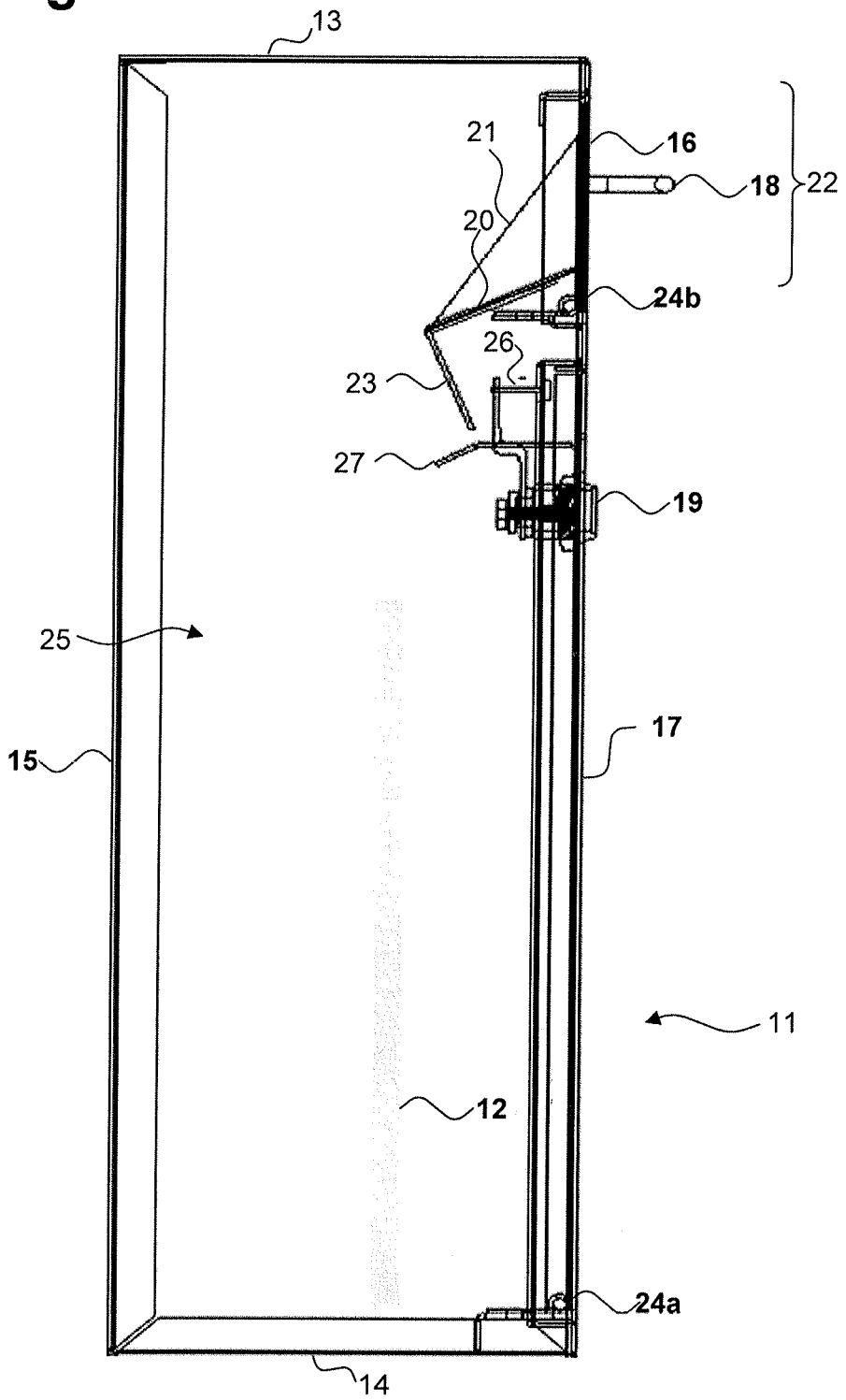
FIG. 1 is a side view showing a theft-resistant wall mount mailbox for mail bundles and small parcels, in accordance with one embodiment.

A theft-resistant wall mount locking mailbox can prevent would-be thieves from accessing personal mail. FIG. 1 is a side view showing, by way of example, a theft-resistant wall mount mailbox 11 for mail 12 bundles and small parcels. The mailbox includes a housing that includes top 13, bottom 14 and back 15 sides, as well as a front side having a mail delivery door 16 and a mail retrieval door 17. Together, the sides form an enclosure for storing mail and small parcels. In one embodiment, the housing can be shaped as a rectangle with the front and back sides longer than the top and bottom sides. The shape and size of the mailbox housing and mail delivery door can be varied to allow mail bundles and parcels of different sizes, while still having a size small enough to be mounted on a wall.

The mailbox 11 can be securely affixed to a wall surface (not shown) of wood, stucco, cement, brick, or other materials using hardware. Specifically, the rear or back side 15 wall of the mailbox can include a variable number of pre-drilled holes (not shown) that allow for the mailbox 11 to be attached to a wall surface using wood screws, masonry screws, or other appropriate hardware. The number of holes and screws can vary depending on the application.

Once affixed to a wall surface, mail can be delivered through the mail delivery door 16 and retrieved through the mail retrieval door 17. Generally, the mail delivery door 16 can be non-lockable to allow postal carriers to deposit mail within the mail box, while the mail retrieval door 17 can be lockable to prevent would-be thieves from accessing the mail once inside the mailbox. Further, each of the doors can include a handle 18 to assist with opening of the respective door.

The lockable mail retrieval door includes a flat surface that lies along a front surface of the mailbox in a closed position and an anti-pry lock 19 to prevent access to delivered mail or articles, except by those individuals having a key to operate a locking mechanism. The mail retrieval door can be pivotably mounted on the front side of the mailbox 11 at a bottom edge via a fulcrum 24*a* to allow the doors to rotate in open and closed positions. Fulcrum fixation of the parcel receipt door 16 can include a hinge style attachment, a ball and joint device, rods, or a gear mechanism. Other methods and components for affixing the parcel receipt door to the fulcrum can be used.

When opened, the flat surface of the door moves outward away from the front surface of the mailbox. Prior to being opened, a user or owner of the mailbox must insert a proper key into the anti-pry lock 19 to unlock the door 17. The anti-pry lock 19 is further described below with reference to FIGS. 5-8. The anti-pry lock 19 utilizes a striker pin 26 and an anti-pry plate 27 to prevent a third party from forcefully pulling open the mail retrieval door 17 and accessing any mail within the mailbox. Other components and mechanisms for securing the lockable door to the mailbox can be used.

The mail deposit door 16 includes a flat surface that is positioned along a front surface of the mailbox when in a closed position and an inner panel 20, which is located within the interior 25 of the housing 11 and affixed at an angle to the mail delivery door 16 to receive and guide incoming mail and parcels into the mailbox 11. More specifically, a proximal edge of the inner panel 20 can be affixed to the bottom edge of the mail deposit door 16. The angle between the inner panel 20 and mail delivery door 16 can vary to accommodate different size envelopes and packages. In one embodiment, the angle is at least as great as a right angle. Together, the mail delivery door 16 and inner panel 20 rotate about a horizontal axis based on the opening and closing of the parcel receipt door 16. A sphere of rotation is defined by movement of a distal edge of the inner panel within the housing based on the horizontal axis.

Additionally, one or more side panels 21 can be interfixed between the mail delivery door 16 and inner panel 20 to assist in guiding the envelope or parcel into the mailbox 11. The side panels 21 can include a rod, bar, or flat surface. Other types of side panels are possible. Together, the parcel receipt door 16, inner panel 20, and side panels 21 form a rotatable mail deposit 22 that allows mail carriers and other individuals to deliver mail, envelopes, parcels, and other articles into the mailbox 11. The rotatable mail deposit 22 can be rotatably affixed to the front surface of the housing 11 via the parcel receipt door 16, as described above, inner panel 20, or side panels 21.

Specifically, the rotatable mail deposit 22 can be rotatably affixed to the housing by a fulcrum 24*b*, allowing for the mail delivery door 16 to open, receive mail and small parcels, and then close, causing the mail and small parcels to slide into a secure area at the bottom inside 25 of the mailbox 11, which is protected by the locked mail retrieval door 17. The fulcrum can be attached to the mail delivery door 16 or inner panel 20, or both. Fulcrum 24*b* fixation of the mail delivery door can include a hinge style attachment to a base of the mail delivery door 16, a ball and joint device, rods, or a gear mechanism. Other methods and components for affixing the fulcrum 24*b* can be used. The mail delivery door 16 is affixed by the fulcrum 24*b* in such a way that the mail delivery door can articulate through a range of motion about a horizontal axis, thus causing the mail delivery door to sweep through an open position to receive mail, all the way to a closed position where the mail delivery door can allow the mail to fall into the interior 25 of the mailbox for safe keeping.

In a further embodiment, the rotatable mail deposit 22 includes a safety arm 23 that is affixed at an angle to the inner panel 20 in a direction away from the mail delivery door 16. In one embodiment, the angle is less than 115 degrees. However, other angles are possible. At a minimum, the angle should be large enough to allow the safety arm to prevent a would-be thief from inserting his arm into the interior of the mailbox, but small enough to allow mail and parcels to pass to the bottom of the mailbox interior. The length of the security arm 23 is dependent on the angle between the inner panel 20 and the security arm 23. The security arm 23 should not extend past a midline of the mailbox 11. The midline can be determined by bisecting a center of the mailbox parallel to the front surface, as described further below with reference to FIG. 2.

Figure 2:
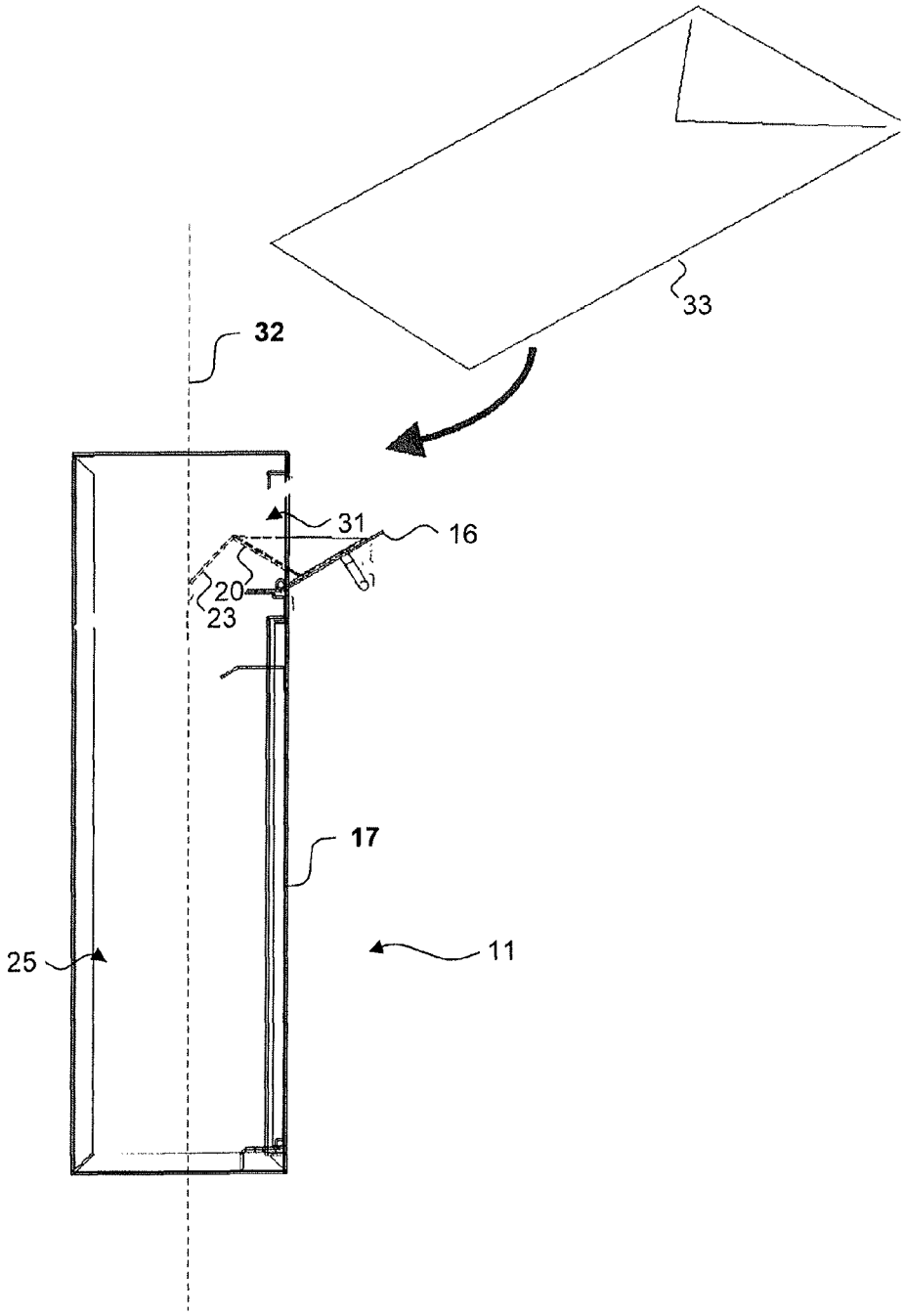
FIG. 2 is a side view showing the theft-resistant wall mount mailbox of FIG. 1 with a mail delivery door in an open position.

Mail or parcels are delivered via the rotatable mail deposit and retrieved through the mail delivery door. FIG. 2 is a side view showing the theft-resistant wall mount mailbox 11 of FIG. 1 with a mail delivery door 16 in an open position. Incoming mail is inserted through a slot 31 to receive mail, or by way of a mail opening formed by opening the non-lockable mail delivery door 16. The security arm 23, or angled bottom member, guides incoming mail 33 into the interior 25 bottom of the mailbox 11. When the rotatable mail deposit 16 is in a closed position, the security arm 23 extends in a downward fashion from the inner panel 20 towards the interior 25 bottom side of the mailbox 11. In one embodiment, the security arm 23 should not extend beyond a midline 32 of the mailbox. As described above, the midline 32 is determined by bisecting a center of the mailbox 11 parallel to the front surface. Extension of the security arm 23 past the midline 32 can impede receipt of the mail 33 into the mailbox 11. The security arm 23 can be made from metal, steel, plastic, wood, or other material.

As the mail delivery door 16 is opened, the security arm 23, or bottom member of the mail delivery door effectively limits the space created when the mail retrieval door is opened. In this way, the opening to the interior 25 of the mailbox 11 is restricted by the space occupied by the security arm 23 as the mail retrieval door moves from the open to the closed position, and at various positions in the range of motion of the mail delivery door. A mail thief would be restricted from putting a hand into the box when the mail retrieval door is open or semi-open.

Once the inbound mail 11 falls to the floor of the mailbox, the mail can be easily retrieved through the locked lower mail retrieval door 17 by individuals with an appropriate key. Unauthorized access to mail or articles that have been delivered is prevented by the lockable mail retrieval door 17. The lockable mail retrieval door 17 has a lock and latch which engages a lock cam with a striker, reinforced by the anti-pry plate, securing the lockable door until it is opened with a key. A locking mechanism suitable for use with the mailbox is described in commonly-owned U.S. Pat. No. 7,441,696, issued on Oct. 28, 2008, the disclosure of which is incorporated by reference and is further described below with reference to FIGS. 5-8.

Figure 3:
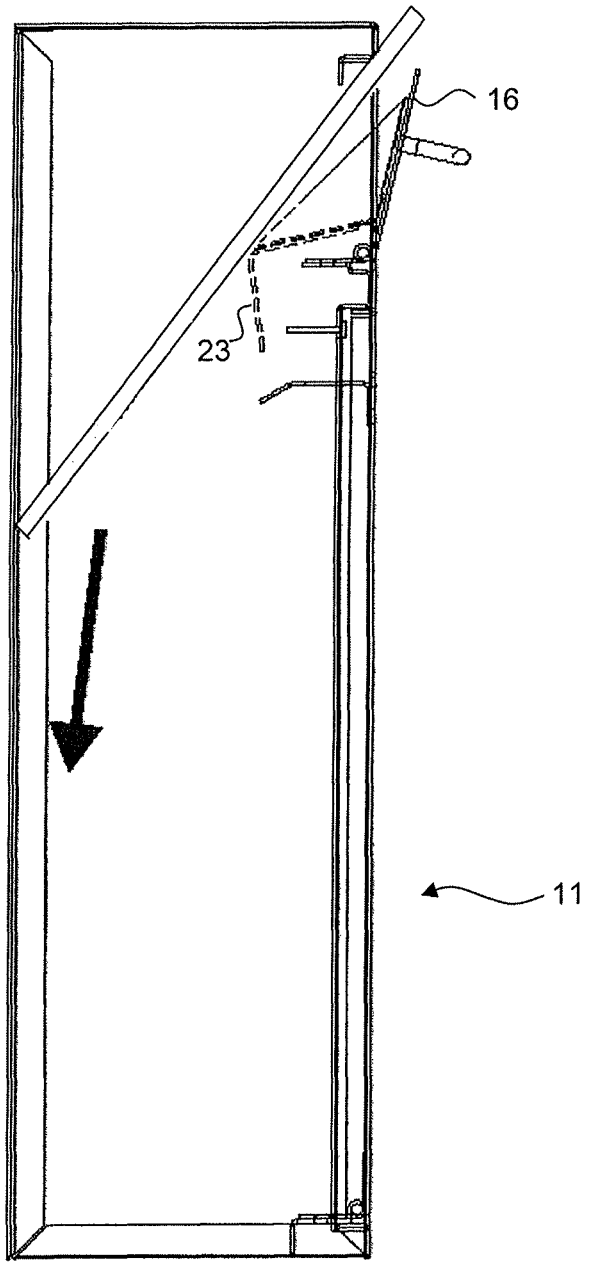
FIG. 3 is side view showing the theft-resistant wall mount mailbox of FIG. 1 with a mail delivery door in a semi-closed position.

FIG. 3 is side view showing the theft-resistant wall mount mailbox of FIG. 1 with a mail delivery door 16 in a semi-closed position. Closing the mail delivery door 16 causes the security arm 23, or bottom member of the mail delivery door to move out of the way and allow the mail bundle or parcel to freely slide into the secure area of the mailbox. As well, the closing of the mail delivery door closes, or reduces the size of the open slot formed when the mail delivery door 16 is open to prevent would be thieves from reaching into the interior of the mailbox 11. Further embodiments can include various slots or spaces so that standard thin envelope mailers and envelope style mail may be inserted without having to close the door. The slots and spaces should be small enough to prevent unauthorized access.

Figure 4:
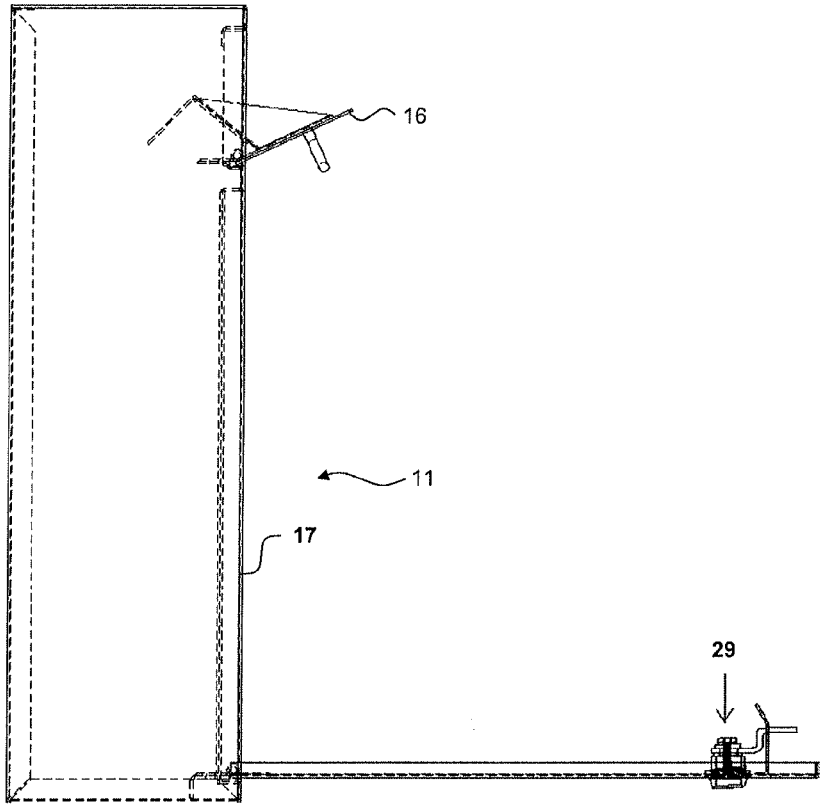
FIG. 4 is a side view showing the theft-resistant wall mount mailbox of FIG. 1 with a mail delivery door in an open position and a mail retrieval door in an open position.
Figure 5:
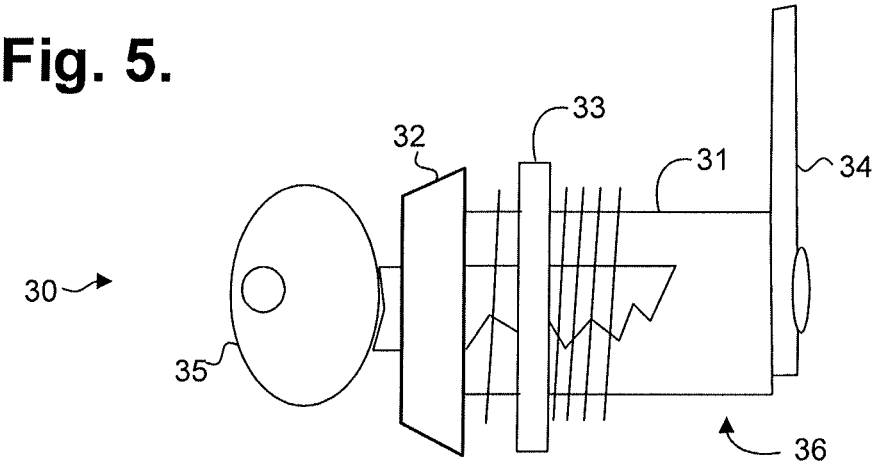
FIG. 5 is a side view showing, by way of example, a locking mechanism for a theft-resistant mailbox.

FIG. 4 is a side view showing the theft-resistant wall mount mailbox of FIG. 1 with a mail delivery door 16 in an open position and a mail retrieval door 17 in an open position. The mail retrieval door 17 can be opened upon unlocking of the anti-pry lock 29. FIG. 5 is a side elevational view showing a locking mechanism 30 for a theft-resistant mailbox, in accordance with one embodiment. The locking mechanism 30 can include an anti-pry lock having a locking tumbler 31 and matching key 35, which are installable in a mailbox door or similar enclosure, such as the mail retrieval door 17. Additionally, the locking mechanism 30 could be installed on a fixed surface against which a door opening abuts.

Figure 6:
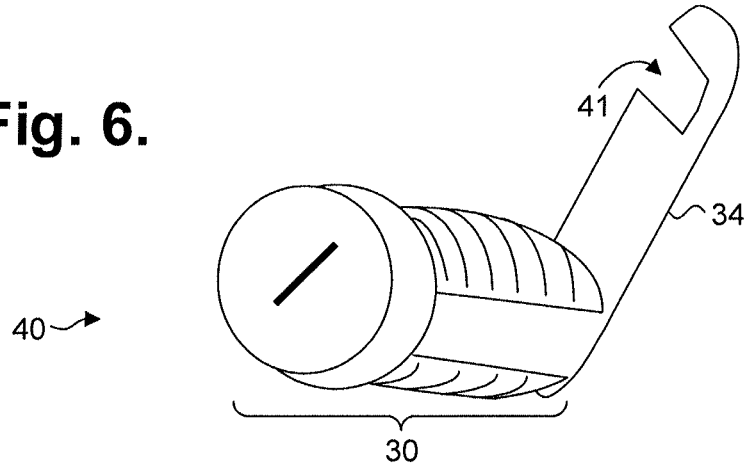
FIG. 6 is perspective view showing the locking mechanism of FIG. 5.

The locking mechanism 30 is installed by fitting the tumbler 31 through a fitted opening sized to receive the outside barrel of the tumbler 31 and sliding the tumbler 31 into the opening until the inside edge of a keyway facing 32 engages the outer edge of the mailbox door. The locking mechanism 30 is fastened into place by tightening a retaining bolt 33, or similar fastener, such as a retaining clip or fastener assembly. The tumbler 31 is rotatably coupled to an internal cam 34, which locks the mailbox door when the door is closed and the key 35 is turned. The internal cam 34 rotates freely in the same direction as the key 35, while the outside barrel of the tumbler 31 remains fixed in place on the mailbox door. FIG. 6 is perspective view showing the locking mechanism 30 of FIG. 5. The far edge of the internal cam 34 is formed into a cutout 41 that is open in the angle of rotation. The cutout 41 can be square or rectangular, as well as U- or C-shaped. Other shapes of cutouts are possible.

Figure 7:
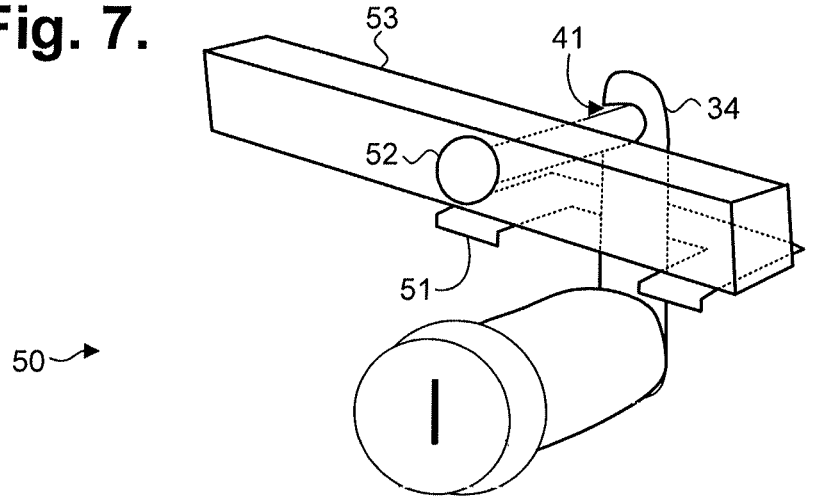
FIG. 7 is perspective view showing the locking mechanism of FIG. 5 as installed within a theft-resistant mailbox.

The locking mechanism 30 also includes components installed within the mailbox. FIG. 7 is perspective view showing the locking mechanism 30 of FIG. 5 as installed within a theft-resistant mailbox. A striker pin 52 is fixedly attached to a frame 53 within the interior of the mailbox. Alternatively, the striker pin 52 can be installed within the mailbox door within which the locking mechanism is installed. The cutout 41 of the internal cam 34 is sized to be received over the striker pin 52. When the key 35 is turned, the cutout 41 engages the internal cam 34 over the striker pin 52. In addition, an anti-pry plate 51 is fixedly attached to the inside surface of the mailbox door above the tumbler 31. The anti-pry plate 51 surrounds the internal cam when the locking mechanism is in the locked position.

Figure 8:
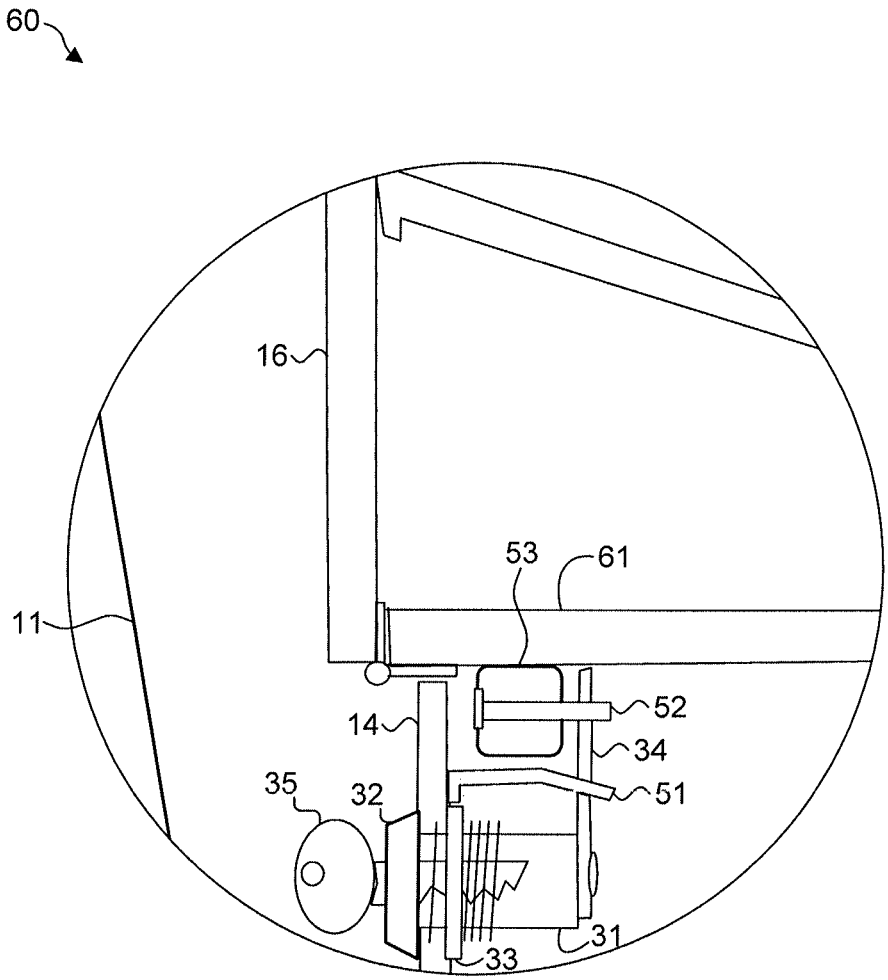
FIG. 8 is a cross-sectional view showing the locking mechanism of FIG. 5 as installed within a theft-resistant mailbox.

The internal cam 34, striker pin 52, and anti-pry plate 51 synergistically protect a mailbox door against compromise. FIG. 8 is a cross-sectional view 60 showing the locking mechanism 30 of FIG. 5 as installed within a theft-resistant mailbox 11. The frame 53 is fixably attached to a chassis 61 of the mailbox 11. Additionally, the striker pin 52 extends beyond the point of engagement to the internal cam 34. A prying force applied to the mailbox door 14 would be transferred onto the mailbox chassis 61 through the combination of the cutout 41, striker pin 52, and frame 53, as well as onto the mailbox door 14 through the anti-pry plate 51. As a result, a would-be theft would have to provide force significantly greater than required to overcome a conventional key-and-tumbler cam.

In a further embodiment, a bin, or rotating mail deposit suitable for use with the mailbox is described in commonly-owned U.S. Pat. No. 7,946,472, the disclosure of which is incorporated by reference.

While the invention has been particularly shown and described as referenced to the embodiments thereof, those skilled in the art will understand that the foregoing and other changes in form and detail may be made therein without departing from the spirit and scope of the invention.

What is claimed is:

1. A theft-resistant wall mount mailbox, comprising:

a housing having a rectangular shape with a front side and a back side;

a rotatable mail deposit pivotably attached to the front side of the housing and comprising a mail delivery door, an inner panel affixed on a proximate end at an angle to a bottom of the mail delivery door, and a safety arm affixed at a further angle to a distal end of the inner panel limiting access to an interior of the housing and pointing towards the front side of the housing when the rotatable mail deposit is in a closed position, wherein a length of the safety arm is dependent on the further angle between the inner panel and the safety arm, preventing the safety arm from extending past a midline of the housing, wherein the midline bisects a center of the housing parallel to the front side;

a mail slot formed as an opening in the front side of the housing when the rotatable mail deposit is in an open position allowing mail to be deposited over a top surface of each of the inner panel and the safety arm; and a mail retrieval door located below the rotatable mail deposit and pivotably attached to the front side of the housing.

2. A theft-resistant wall mount mailbox according to claim 1, further comprising:

an anti-pry lock comprising a barrel inserted within the mail retrieval door and a cam extending from the barrel into an interior of the housing.

3. A theft-resistant wall mount mailbox according to claim 2, further comprising:

a striker affixed to the mail retrieval door above the barrel and shaped to be received by the cam.

4. A theft-resistant wall mount mailbox according to claim 3, further comprising:

an anti-pry plate affixed to the mail retrieval door above the barrel and below the striker, and shaped to surround the cam.

5. A theft-resistant wall mount mailbox according to claim 1, further comprising:

one or more side panels interfixed between the mail delivery door and the inner panel.

6. A theft-resistant wall mount mailbox according to claim 1, wherein the back side of the housing comprises one or more holes each sized to receive a screw.

7. A theft-resistant wall mount mailbox according to claim 1, wherein at least one of the rotatable mail deposit and the mail retrieval door are attached to the front side of the housing via a fulcrum.

8. A theft-resistant wall mount mailbox according to claim 7, further comprising:

a fulcrum attachment mechanism to affix the fulcrum to the front side of the housing and at least one of the rotatable mail deposit and the mail retrieval door comprising one of a hinge attachment, ball and joint device, rods, and a gear mechanism.

9. A method for constructing a theft-resistant wall mount mailbox, comprising:

providing a housing having a rectangular shape with a front side and back side;

pivotably attaching to the front side of the housing a rotatable mail deposit comprising a mail delivery door, an inner panel affixed on a proximate end at an angle to a bottom of the mail delivery door, and a safety arm affixed at a further angle to a distal end of the inner panel limiting access to an interior of the housing and point towards the front side of the housing when the rotatable mail deposit is in a closed position, wherein a length of the safety arm is dependent on the further angle between the inner panel and the safety arm, preventing the safety arm from extending past a midline of the housing, wherein the midline bisects a center of the housing parallel to the front side;

forming a mail slot as an opening in the front side of the housing when the rotatable mail deposit is in an open position allowing mail to be deposited over a top surface of each of the inner panel and the safety arm when the rotatable mail deposit is in an open position; and pivotably attaching to the front side of the housing a mail retrieval door below the rotatable mail deposit.

10. A method according to claim 9, further comprising:

inserting an anti-pry lock comprising a barrel into the mail retrieval door; and affixing a cam extending from the barrel into an interior of the housing.

11. A method according to claim 10, further comprising:

affixing a striker to the mail retrieval door above the barrel, wherein the striker is shaped to be received by the cam.

12. A method according to claim 11, further comprising:

affixing an anti-pry plate to the mail retrieval door above the barrel and below the striker, wherein the anti-pry plate is shaped to surround the cam.

13. A method according to claim 9, further comprising:

interfixing one or more side panels between the mail delivery door and the inner panel.

14. A method according to claim 9, wherein the back side of the housing comprises one or more holes each sized to receive a screw.

15. A method according to claim 9, wherein at least one of the rotatable mail deposit and mail retrieval door are attached to the front side of the housing via a fulcrum.

16. A method according to claim 15, further comprising:

affixing the fulcrum to the front side of the housing and at least one of the rotatable mail deposit and the mail retrieval door via a fulcrum attachment mechanism comprising one of a hinge attachment, ball and joint device, rods, and a gear mechanism.

* * * * *